US006439836B1

(12) United States Patent
Pozivil

(10) Patent No.: US 6,439,836 B1
(45) Date of Patent: Aug. 27, 2002

(54) CRYOGENIC TURBO-EXPANDER

(75) Inventor: Josef Pozivil, Haselweg (CH)

(73) Assignee: Cryostar-France SA, Hesingue (FR)

( * ) Notice: Subject to any disclaimer, the term of this patent is extended or adjusted under 35 U.S.C. 154(b) by 0 days.

(21) Appl. No.: 09/585,739

(22) Filed: Jun. 2, 2000

(30) Foreign Application Priority Data

Jun. 4, 1999 (GB) ..... 9913072

(51) Int. Cl.[7] ..... F04D 29/08
(52) U.S. Cl. ..... 415/110; 415/111; 415/112
(58) Field of Search ..... 415/110, 111, 415/112

(56) References Cited

U.S. PATENT DOCUMENTS

| | | | | |
|---|---|---|---|---|
| 2,660,367 A | * | 11/1953 | Ehlinger | 415/112 |
| 2,910,328 A | * | 10/1959 | Flolich | 415/112 |
| 3,420,434 A | * | 1/1969 | Swearingen | 415/112 |
| 4,099,727 A | * | 7/1978 | Weiler | 415/112 |
| 4,606,652 A | | 8/1986 | Swearingen | |
| 5,253,985 A | | 10/1993 | Ruetz | |

FOREIGN PATENT DOCUMENTS

| | | |
|---|---|---|
| EP | 0671567 | 9/1995 |
| GB | 2024330 | 1/1980 |
| WO | WO94/21932 | 9/1994 |

* cited by examiner

*Primary Examiner*—John Kwon
(74) *Attorney, Agent, or Firm*—Wan Yee Cheung; Salvatore P. Pace

(57) ABSTRACT

A cryogenic turbo-expander has a rotary shaft which carries a turbine wheel and carries or is operatively associated with an energy dissipating device and which extends axially through a sleeve. Two sets of bearings, which are housed by two races surrounding the shaft, are axially spaced from one another. Each race has an aperture therein extending from an outer to an inner surface thereof communicating with a lubricating oil passage extending from an outer surface to an inner surface of the sleeve. Both races are arranged so that spent lubricating oil can pass therefrom to a common drain passage. The cryogenic turbo-expander additionally includes a reservoir for lubricating oil communicating with the aperture in the first race via an intermittently-operable metering pump and with the second race via an intermittently operable metering pump.

7 Claims, 3 Drawing Sheets

CRYOGENIC TURBO-EXPANDER

BACKGROUND OF THE INVENTION

This invention relates to a cryogenic turbo-expander having a rotary shaft with anti-friction bearings which carries a turbine wheel and an energy dissipating means.

By the term "cryogenic turbo-expander" as used herein is meant a turbo-expander operable to create a temperature below minus 20° C., preferably below minus 100° C.

The energy dissipating device is typically a compressor wheel. The rotary shaft typically has two axially spaced lubricated bearing means. The lubricant is supplied in the form of a mist (i.e. in divided form), to a passage along the shaft which communicates with both bearing means.

Cryogenic turbo-expanders operate at very high rotary speeds of at least 25,000 revolutions per minute. A rotary speed of about 30,000 to 50,000 revolutions per minute is typical. Such high speeds result in a considerable generation of heat at the bearings. As a result, the consumption of lubricating oil is undesirably high. Not only does a high consumption of lubricating oil add to the cost of operating the machine, it also has the consequence that a particularly large lubricating oil reservoir is required, therefore adding appreciably to the size of the machine.

It is an aim of the present invention to provide a cryogenic turbo-expander having a reduced consumption of lubricating oil in comparison with the machine described above.

SUMMARY OF THE INVENTION

According to the present invention there is provided a cryogenic turbo-expander having a rotary shaft which carries a turbine wheel and carries or is associated with an energy dissipating means and which extends axially through a sleeve, first race means surrounding the shaft and housing first bearing means for the shaft, second race means surrounding the shaft and housing second anti-friction bearing means for the shaft, the first and second bearing means being axially spaced from one another, wherein each race means has an aperture therein extending from an outer to an inner surface thereof communicating with a lubricating oil passage extending from an outer surface to an inner surface of the sleeve and wherein both race means are arranged so that spent lubricating oil can pass therefrom to a common drain damage, the cryogenic turbo-expander additionally including a reservoir for lubricating oil communicating with the aperture in the first race means via an intermittently-operable metering pump and with the aperture in the second race means via an intermittently operable oil metering pump.

A cryogenic turbo-expander according to the invention is able to be operated with a reduced lubricating oil consumption in comparison with the machine described above. This result may be attributed to the fact that the lubricating oil is able to be supplied directly to both bearing means without travelling along the shaft and hence is supplied only intermittently but preferably is undivided form.

Both bearing means are preferably of an anti-friction kind.

Although it is possible for the passages through the sleeve to have a common inlet it is preferred that the passage communicating with the aperture in the first race be separate from the passage communicating with the aperture in the second sleeve.

The first and second oil metering pumps preferably inject lubricant into both race means at predetermined times so as to lubricate the bearings. Typically, lubricating oil is injected into both bearings 6 to 10 times per hour. The first and second oil metering pumps may additionally or alternatively be adapted to respond to signals from temperature sensors in the respective races. In this way, the creating of excessive temperatures in the races may be avoided.

The oil metering pumps are preferably both of a piston kind and are preferably both actuated by a solenoid.

The energy dissipating means is preferably a compressor wheel but may alternatively be any high speed braking device (for example, an eddy current brake or a frictional brake wheel) or a high frequency electrical generator.

A cryogenic turbo-expander according to the invention is particularly suited for use in a cryogenic air separation plant, for example a nitrogen generator.

DETAILED DESCRIPTION OF THE INVENTION

Figure 1:
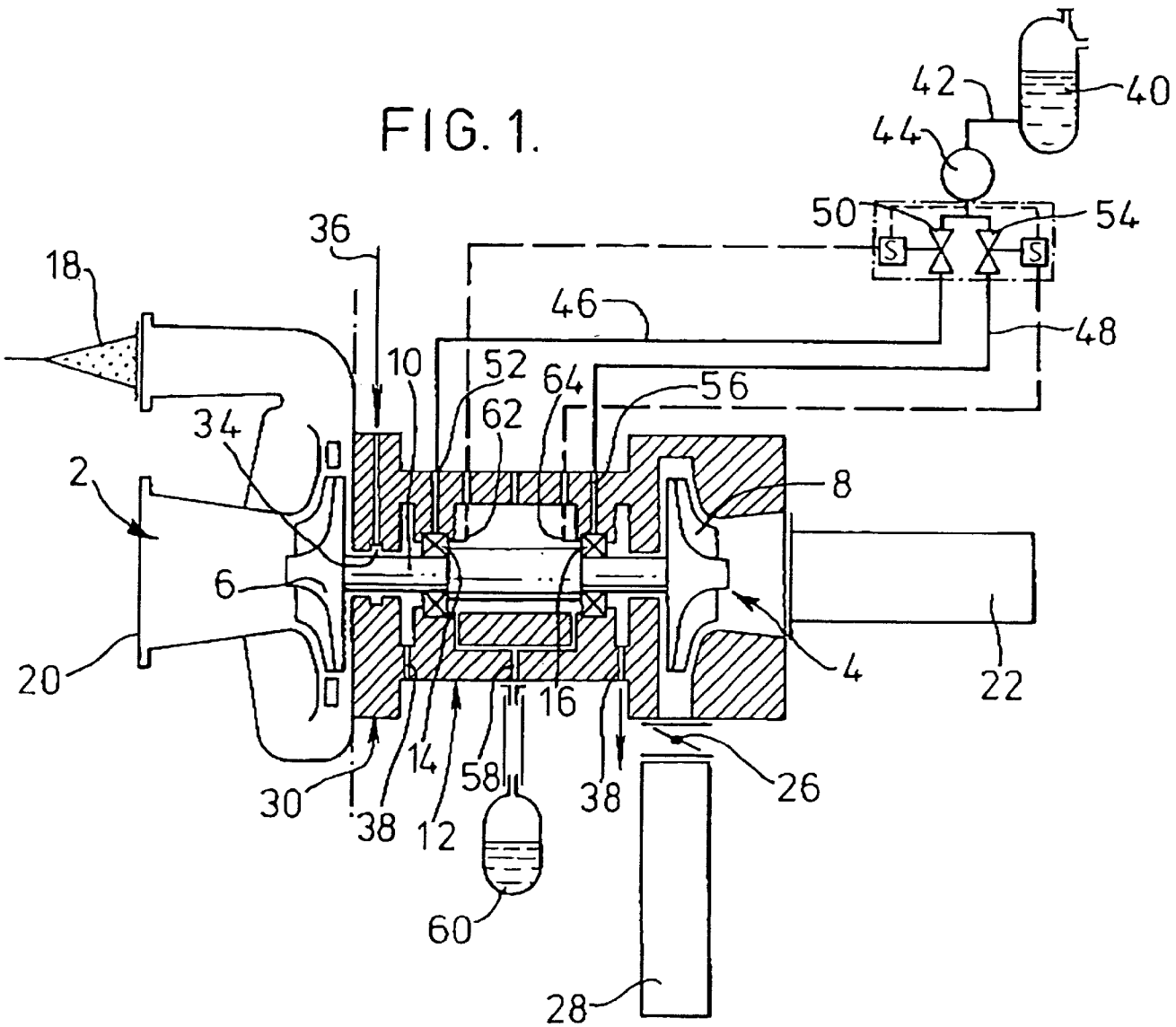
FIG. 1 is a schematic drawing of the cryogenic turbo-expander illustrating the arrangement for supplying lubricating oil to its bearings.

With reference to the drawings and particularly to FIG. 1, the cryogenic turbo-expander shown therein comprises a turbine 2 and a compressor 4. The turbine 2 includes a wheel 6 and the compressor 4 a wheel 8. The wheel 6 is mounted at one end of a rotary shaft 10 and the compressor wheel 8 at the other end thereof. The shaft 10 extends axially through a sleeve (or housing) 12. There are two sets 14 and 16 of bearings for supporting the shaft. The set 14 is spaced axially from the set 16. The bearing arrangements are shown only schematically in FIG. 1 and will be described in more detail below with reference to FIGS. 2 and 3.

In operation compressed gas (e.g. air) passes through a filter 18 into the turbine 2 and is expanded by the wheel 6 to a lower pressure. The expanded gas leaves the turbine 2 through an outlet 20 at a lower, typically cryogenic temperature (e.g. a temperature less than about 175K). The expanding gas in the turbine 2 performs work in compressing gas in the compressor 4. The wheel 8 is thus caused to rotate and draws in gas to be compressed via a filter/silencer 22. The compressed gas leaves the compressor 4 through an outlet 24, and passes through a valve 26 and a further filter/silencer 28.

In view of the low temperatures generated in the turbine 2 the machine is provided with a thermal shield 30 which limits the flow of heat from its non-cryogenic parts to its cryogenic parts.

In order to prevent the flow of gas being expanded in the turbine 2 to the non-cryogenic parts of the machine along the shaft 10, a labyrinthine seal (not shown) is provided at 34. The sealing action is enhanced by the supply of a dry seal gas (e.g. nitrogen) to the non-cryogenic side of the seal via a passage 36. Seal gas is vented from the machine via passages 38.

In all respects so far described with reference to FIG. 1, the turbo-expander according to the invention is conventional. The turbo-expander however has unique arrangements for the lubrication of its bearings. The turbo-expander has an oil tank (i.e. reservoir) 40 associated therewith. The tank 40 has a bottom outlet 42 out of which, in operation, oil is able to flow under gravity (but, if desired, is preferably assisted by a pump and/or a small over-pressure in the ullage space of the tank 40). The oil passes through a filter 44 and is divided into two equal flows. One flow passes to a first oil line 46 and the other to a second oil line 48. The oil flow in the first line 46 is through a first solenoid valve 50 to a first passage 52 which extends from an external surface of the sleeve 12 to an internal surface thereof and which is arranged to provide lubrication to the first set 14 of bearings. The oil flow in the second line 48 is through a second oil metering pump 54 to a second passage 56 extending from an external surface of the sleeve 12 to an internal surface thereof and arranged so as to be able to provide lubrication to the second set 16 of bearings. The oil metering pumps are preferably both solenoid-actuated piston pumps.

Spent oil flows from the sets 14 and 16 of bearings via drainage passages 58 in the sleeve 12 to a collection vessel 60. The spent oil may be disposed of in an environmentally acceptable manner.

Actuation and de-actuation of the oil metering pumps 50 and 54 may be effected by means of control signals in a known manner at predetermined times, typically form 6 to 10 times per hour. As shown in FIG. 1, a first temperature sensor 62 is positioned in the vicinity of the first set 14 of bearings, and a second temperature sensor 64 is positioned in the vicinity of the second set 16 of bearings. The temperature sensors 62 and 64 are used for bearing status monitoring and for causing the machine to "trip" or shut down if an excessive temperature is detected.

The temperature sensors 62 and 64 may additionally be used in an alternative control arrangement to a time-based one. Thus, as shown in FIG. 1, the sensor 62 may be operatively associated with the first oil metering pump 50 and the sensor 64 with the second oil metering pump 54. Thus, both pumps 50 and 54 may be actuated when the respective sensed temperatures rise above a first chosen value and de-actuated again when the respective sensed temperatures fall below a second chosen value.

Figure 2:
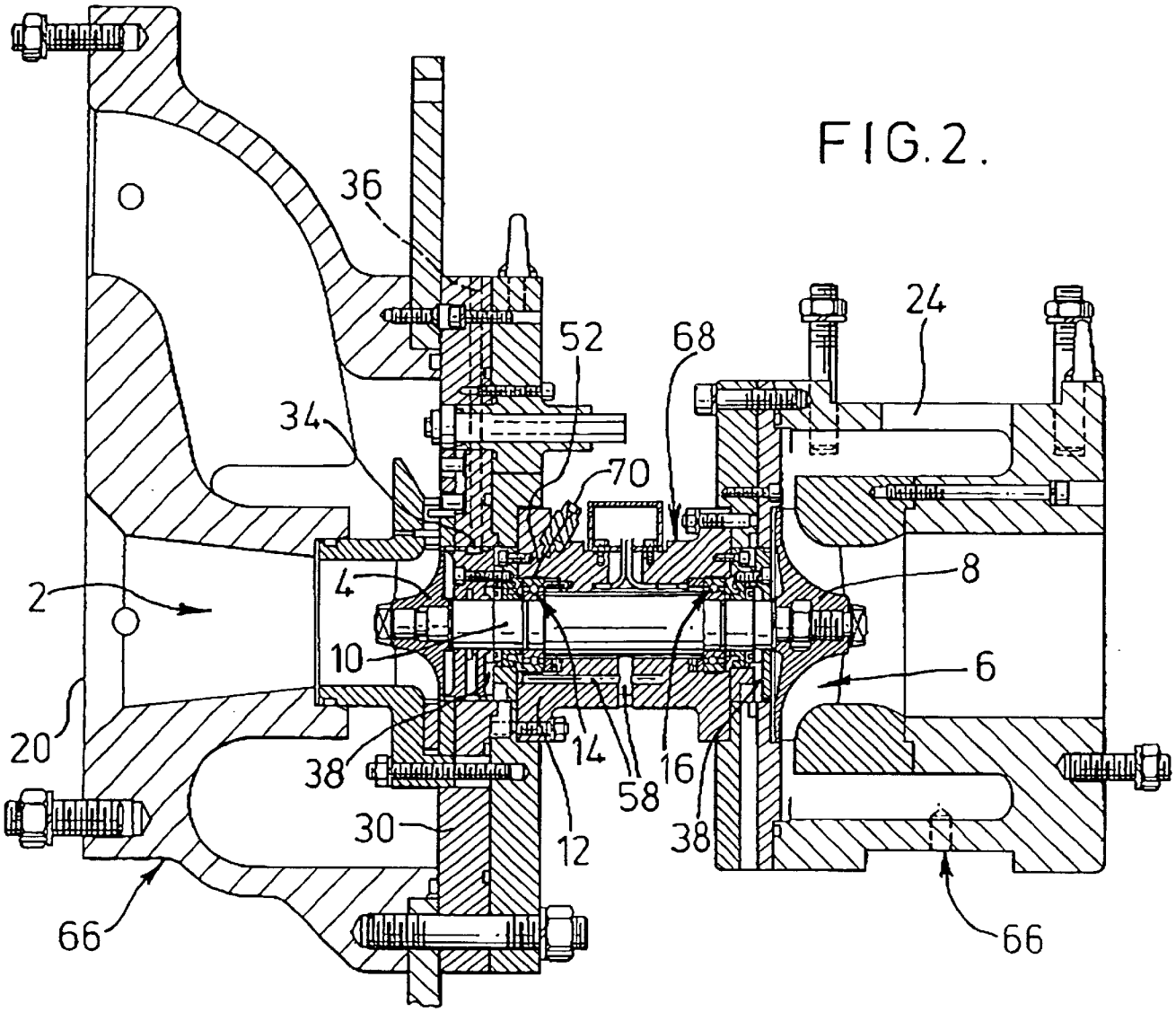
FIG. 2 is a side elevation, partly in section, of the cryogenic turbo-expander shown in FIG. 1.
Figure 3:
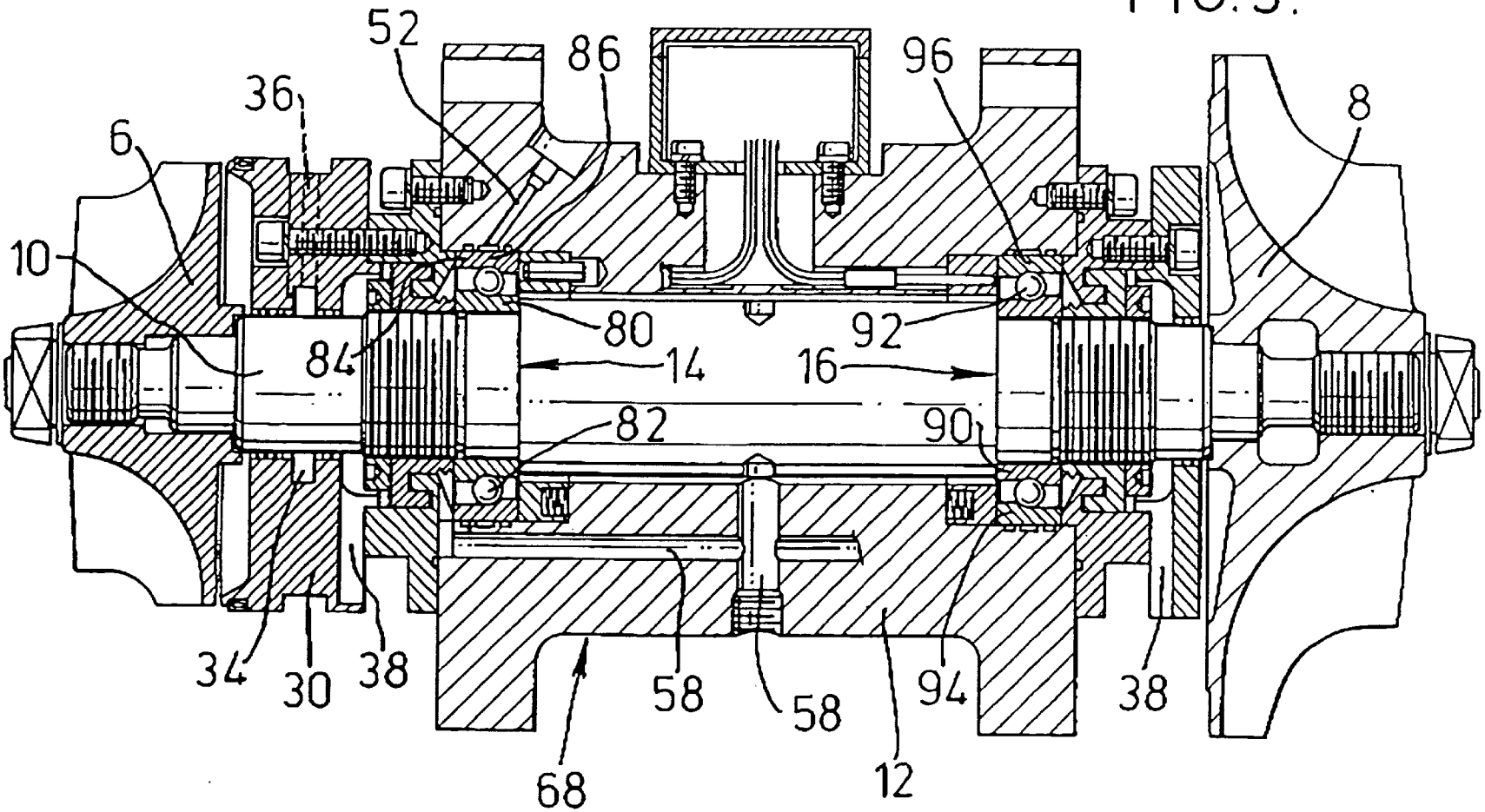
FIG. 3 is a side elevation, partly in section and to a larger scale than FIG. 2, of part of the cryogenic turbo-expander shown in FIG. 2.

The actual construction of the main body of the turbo-expander is shown in more detail in FIGS. 2 and 3 of the drawings. Referring to FIG. 2, there is a main frame or frames 66 and a "cartridge" assembly 68. The cartridge assembly 68 is shown in more detail in FIG. 3. The second passage 56 is offset relative to the first passage 52 and is not shown in FIGS. 2 and 3. Referring to FIG. 2, the first passage 52 is provided with an inlet nozzle (connector) 70 so as to facilitate its connection to the first oil line 46. An analogous inlet nozzle (not shown) is employed so as to facilitate the connection of the second oil line 48 to the second passage 56. The inlet nozzle (connector) 70 is omitted for ease of illustration from FIG. 3. Further, the external oil supply and collection apparatus is not shown in either FIG. 2 or FIG. 3.

The bearings of the turbo-expander are illustrated in more detail in FIG. 3 than in FIG. 1 or FIG. 2. With reference to FIG. 3, there is a set of two or more equally circumferentially spaced generally spherical anti-friction bearings 82 which are located within race means comprising an outer annular race 84 engaging an inner surface of the sleeve 12 and an inner annular race 80 engaging the shaft 10. The bearings 82 make only tangential or point contact with the inner race 80. The bearings 82 may be formed of ceramic and the races 80 and 84 of metal or alloy (e.g. steel), or vice versa. In order to enable the lubricating oil to come into contact with the bearings 82 the outer race 84 has a narrow radial aperture 86 formed therein, the aperture 86 being in register and communication with the outlet of the first passage 52. The aperture 86 lies in a vertical plane bisecting the inner race 80. In use the lubricant tends to migrate axially to outlets (not shown) communicating with the passages 58.

The set 16 of bearings comprises an analogous arrangement of a set of two or more equally spaced generally spherical bearings 92 located within race means comprising an inner annular race 90 and an outer annular race 94, the latter having an aperture 96 for the passage of oil.

Various changes and modifications can be made to the turbo-generator shown in the drawings. For example the sets of bearings 82 and 92 may both be replaced by single annular bearings.

While an embodiment of the present invention has been described in detail, it should be apparent that further modifications and adaptations of the invention will occur to those skilled in the art. It is to be expressly understood, however, that such modifications and adaptations are within the spirit and scope of the invention.

I claim:

1. A cryogenic turbo-expander having a rotary shaft which carries a turbine wheel and carries or is operatively associated with an energy dissipating means and which extends axially through a sleeve, first race means surrounding the shaft and housing first bearing means for the shaft, second race means surrounding the shaft and housing second bearing means for the shaft, the first and second bearing means being axially spaced from one another, wherein each race has an aperture therein extending from an outer to an inner surface thereof communicating with a lubricating oil passage extending from an outer surface to an inner surface of the sleeve, and wherein both race means are arranged so that spent lubricating oil can pass therefrom to a common drain passage, the cryogenic turbo-expander additionally including a reservoir for lubricating oil communicating with the aperture in the first race means via an intermittently-operable oil metering pump and with the aperture in the second race means via an intermittently-operable oil metering pump.

2. The cryogenic turbo-expander of claim 1 in which the passage communicating with the aperture in the first race means is separate from the passage communicating with the aperture in the second race means.

3. The cryogenic turbo-expander of claim 1 in which the first and second oil metering pumps are adapted to respond to signals from respective temperature sensors in the vicinity of the respective race means.

4. The cryogenic turbo-expander of claim 1 in which the energy dissipating means is a compressor wheel.

5. The cryogenic turbo-expander of claim 1 in which the energy dissipating means is a frictional brake wheel.

6. The cryogenic turbo-expander of claim 1 in which the energy dissipating means is an eddy current brake or a high frequency generator.

7. The cryogenic turbo-expander of claim 1 in which the first and second bearing means are anti-friction bearing means.

* * * * *